US005271220A

United States Patent [19]

Holmes et al.

[11] Patent Number: 5,271,220

[45] Date of Patent: Dec. 21, 1993

[54] COMBUSTOR HEAT SHIELD FOR A TURBINE CONTAINMENT RING

[75] Inventors: Arnold Holmes, San Diego; Anthony P. Batakis, Caminito Pajari, both of Calif.

[73] Assignee: Sundstrand Corporation, Rockford, Ill.

[21] Appl. No.: 961,562

[22] Filed: Oct. 16, 1992

[51] Int. Cl.[5] ..... F02G 3/00

[52] U.S. Cl. ..... 60/39.091; 60/39.32; 60/39.36

[58] Field of Search ..... 60/39.091, 39.32, 39.36, 60/752, 754, 755, 760

[56] References Cited

U.S. PATENT DOCUMENTS

| | | | |
|---|---|---|---|
| 3,869,864 | 3/1975 | Bunn | 60/39.36 |
| 3,989,407 | 11/1976 | Cunningham | 60/39.091 |
| 4,149,824 | 4/1979 | Adamson | 60/39.091 |
| 4,158,949 | 1/1979 | Reider | 60/39.36 |
| 4,222,230 | 9/1980 | Bobo et al. | 60/39.36 |
| 4,944,152 | 7/1990 | Shekleton | 60/39.36 |
| 4,949,545 | 8/1990 | Shekleton | 60/39.36 |
| 4,955,192 | 9/1990 | Shekleton | 60/39.36 |
| 5,062,262 | 11/1991 | Shekleton et al. | 60/39.36 |
| 5,129,224 | 7/1992 | Shekleton | 60/39.36 |

*Primary Examiner*—Richard A. Bertsch
*Assistant Examiner*—Howard R. Richman
*Attorney, Agent, or Firm*—Sundstrand Corporation

[57] ABSTRACT

This invention relates to a combustor heat shield assembly for a containment ring for use in a radial inflow turbine engine having a compressed air supply and a combustor. The combustor heat shield assembly includes a turbine nozzle assembly which is adapted for receiving a mixture of compressed air and combustion by-products delivered by the combustor to drive a turbine impeller of the radial inflow turbine engine about an axis of rotation. The turbine nozzle assembly is integrally connected with and in close radial proximity to the containment ring. A heat shield, provided with slots, is coupled to the turbine nozzle assembly and thermally adapted for providing a circumferentially uniform seal between the turbine nozzle assembly and the heat shield during operation of the radial inflow turbine engine. The heat shield is simultaneously adapted for receiving a portion of the compressed air supply through the slots to create a film of cooling air along an inner surface of the heat shield which is in close radial proximity to the containment ring. The film of cooling air along the inner surface of the heat shield maintains acceptable operating temperatures for the heat shield separating the containment ring from the mixture of compressed air and combustion by-products. The heat shield further directs the film of cooling air to combine with the mixture of compressed air and combustion by-products for delivery by the combustor to the turbine nozzle assembly to drive the turbine impeller of the radial inflow turbine engine about the axis of rotation.

9 Claims, 2 Drawing Sheets

COMBUSTOR HEAT SHIELD FOR A TURBINE CONTAINMENT RING

TECHNICAL FIELD

This invention relates to a combustor heat shield assembly for a turbine containment ring which is designed to provide thermal flexibility while minimizing the amount of air cooling required to maintain the structural integrity of the heat shield assembly.

BACKGROUND ART

Radial inflow gas turbine engines must be designed for light-weight turbine wheel containment. This requirement of containment may impose upon the design constraints required for a combustor, specifically because a small diameter containment ring is located between a turbine nozzle shroud and a combustor inner liner to contain turbine blades in case of mechanical failure due to excess temperature or wear. The containment ring must be kept relatively cool to retain high performance material properties and containment capability. To protect the containment ring from hot combustion gases in the combustor, a heat shield may be employed as an extension of the combustor inner liner. This heat shield seals against the turbine nozzle shroud near its outer diameter while film air cooling may be used to maintain acceptable heat shield operating temperatures. A circumferentially uniform seal and low heat shield temperatures are imperative for high combustor performance and extended engine life.

Problems associated with employing a heat shield in the design of a gas turbine engine are twofold. First, differential growth between the heat shield and the turbine nozzle shroud during thermal transients can plastically deform the heat shield. Such deformation, which is aggravated by a relatively large seal diameter, may degrade the seal between the heat shield and the turbine nozzle shroud. Secondly, combustor performance design requirements limit an amount of air flow available to cool the heat shield. In most combustor designs, a significant amount of air flow cannot be tolerated as pure leakage.

The desirability of optimizing design while providing adequate cooling for a containment ring is recognized in a patent to Shekleton, U.S. Pat. No. 4,955,192, in which a dilution air path is employed. Small openings may be included in a gas turbine to inject air into a combustion annulus to produce a localized air film on inwardly facing surfaces of inner, outer, and radially extending walls which define the combustion annulus. As a consequence, a containment ring may be located at a radially inward position to minimize its mass and may be adequately cooled to allow use of nonexotic materials in fabricating the same. However, the patent to Shekleton does not, as the invention to be described more fully hereinafter, disclose an inner slotted surface of an inner combustor wall which abuts to an inner surface of an annular lip of a rear turbine nozzle shroud to accommodate thermal transients between the same, while simultaneously providing localized air film cooling of the inner slotted surface acting as a heat shield for a containment ring.

The problem of decreased operational efficiency and potential mechanical failure caused by significant thermal growth from extremely high temperatures on a turbine side of an engine is also discussed in a patent to Harris et al, U.S. Pat. No. 4,932,207. The Harris patent teaches an improved seal plate whereby the clearance between the seal plate, which separates compressor and turbine sections, and a turbine may be minimized to reduce performance losses. The clearance is minimized by forming a seal assembly in part out of a plurality of segments disposed in a circular array which are relatively movable but sealed to each other. However, the patent to Harris does not, as the invention to be described more fully hereinafter, provide for a circumferentially uniform and sound seal to solve a thermal gradient problem between a heat shield and a rear turbine nozzle shroud on the turbine side of the engine by employing slots on an inner face of a combustor annulus which abut a rear turbine nozzle shroud.

An improved structural arrangement for a centrifugal compressor provided with an efficient peripheral diffuser arranged in a closely coupled relationship with a combustion chamber of a gas turbine is disclosed in a patent to Paul et al, U.S. Pat. No. 3,014,694. A means for sealing the gas turbine against leakage of motive fluid and providing for minimum axial loading of high speed bearings which support a turbine shaft is discussed. However, the patent to Paul does not address, as does the instant invention, a problem of accommodating large thermal differential expansion in a gas turbine between a heat shield and a turbine nozzle shroud while minimizing an amount of cooling air required to maintain acceptable heat shield temperatures necessary for heat shield material strength.

DISCLOSURE OF INVENTION

More specifically, this invention relates to a combustor heat shield assembly for a containment ring which contains turbine blades in case of mechanical failure for use in a radial inflow turbine engine having a compressed air supply and a combustor. The combustor heat shield assembly includes a turbine nozzle assembly which is adapted for receiving a mixture of compressed air and combustion by-products delivered by the combustor to drive a turbine impeller of the radial inflow turbine engine about an axis of rotation. The turbine nozzle assembly is integrally connected with and in close radial proximity to the containment ring. A heat shield is coupled to the turbine nozzle assembly and thermally adapted for providing a circumferentially uniform seal between the turbine nozzle assembly and the heat shield during operation of the radial inflow turbine engine. The heat shield is in close radial proximity to the containment ring separating the containment ring from the mixture of compressed air and combustion by-products in the combustor. The heat shield is simultaneously adapted for receiving a portion of the compressed air supply and creating a film of cooling air along an inner surface of the heat shield. The film of cooling air along the inner surface of the heat shield maintains acceptable operating temperatures for the heat shield separating the containment ring from the hot combustion gases in the combustor. The heat shield further directs the film of cooling air to combine with the hot combustion gases in the combustor for delivery to the turbine nozzle assembly to drive the turbine impeller of the radial inflow turbine engine about the axis of rotation.

It is therefore a primary object of the invention to provide a combustor heat shield assembly which is designed to provide a circumferentially uniform seal between a turbine nozzle assembly and a heat shield during operation of a radial inflow turbine engine while simultaneously creating a film of cooling air along the heat shield to maintain acceptable operating temperatures for the heat shield separating a containment ring from hot combustion gases in a combustor.

Another object of the invention is to provide slots along an inner surface of a heat shield integrally forming a portion of an inner wall of a combustor. The slots of the heat shield are designed to abut an annular lip of a turbine nozzle assembly to allow for thermal flexibility between the annular lip of the turbine nozzle assembly and the inner surface of the heat shield during operation of a radial inflow turbine engine.

Yet another object of the invention is to provide lipped edges which line the slots along an inner surface of a heat shield. The lipped edges are designed to direct a portion of a compressed air supply received by the slots and create a film of cooling air along the inner surface of the heat shield. The lipped edges are further designed to direct the film of cooling air to combine with hot combustion gases in a combustor for delivery to a turbine nozzle assembly to drive a turbine impeller of a radial inflow turbine engine about an axis of rotation.

In the attainment of the foregoing objects, the invention contemplates in its preferred embodiment a combustor heat shield assembly for use in a radial inflow turbine engine having a compressed air supply and a combustor which delivers a mixture of compressed air and combustion by-products through a turbine nozzle assembly defined in part by a rear turbine nozzle shroud to drive a turbine impeller of the radial inflow turbine engine about an axis of rotation.

The combustor heat shield assembly includes a containment ring integrally connected with and in close radial proximity to the rear turbine nozzle shroud of the turbine nozzle assembly.

The combustor heat shield assembly further includes a heat shield integrally forming a portion of an inner wall of the combustor and in close radial proximity to the containment ring separating the containment ring from the hot combustion gases in the combustor. The heat shield includes slots along an inner surface of the heat shield which abut an annular lip of the rear turbine nozzle shroud and allow for thermal flexibility between the annular lip of the rear turbine nozzle shroud and the inner surface of the heat shield to provide a circumferentially uniform seal during operation of the radial inflow turbine engine.

The combustor heat shield assembly further includes lipped edges which line the slots provided along the inner surface of the heat shield integrally forming the portion of the inner wall of the combustor. The lipped edges direct the compressed air received by the slots along the inner surface of the heat shield to create a film of cooling air along the inner surface of the heat shield. The film of cooling air maintains acceptable operating temperatures for the heat shield separating the containment ring from the hot combustion gases. The lipped edges further direct the film of cooling air to combine with the hot combustion gases for delivery by the combustor to the turbine nozzle assembly to drive the turbine impeller of the radial inflow turbine engine about the axis of rotation.

Other objects and advantages of the present invention will be apparent upon reference to the accompanying description when taken in conjunction with the following drawings.

BEST MODE FOR CARRYING OUT THE INVENTION

Figure 1:
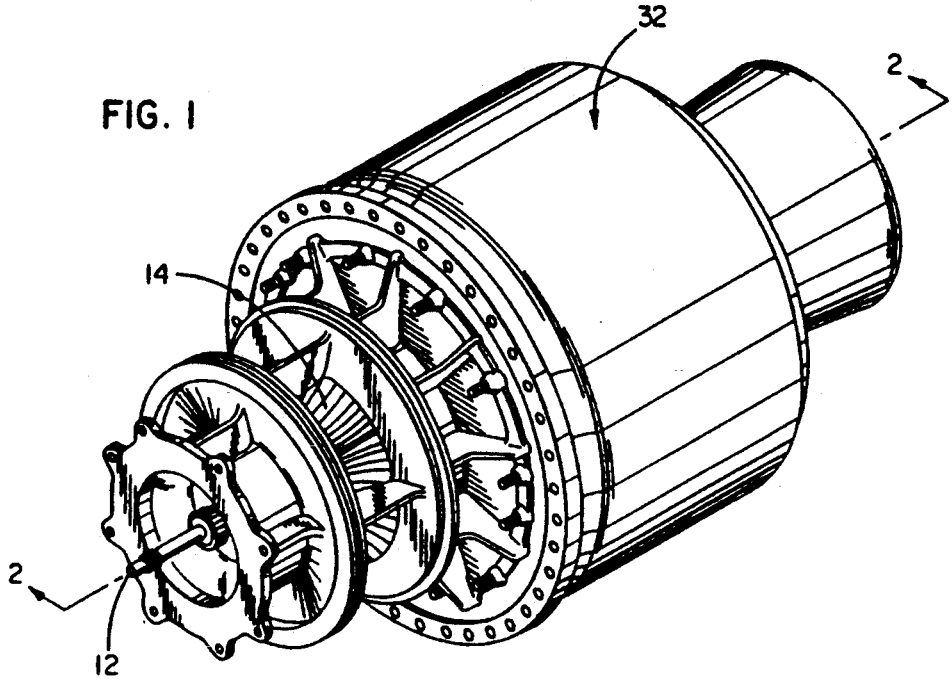
FIG. 1 is a perspective view of a radial inflow gas turbine engine.
Figure 2:
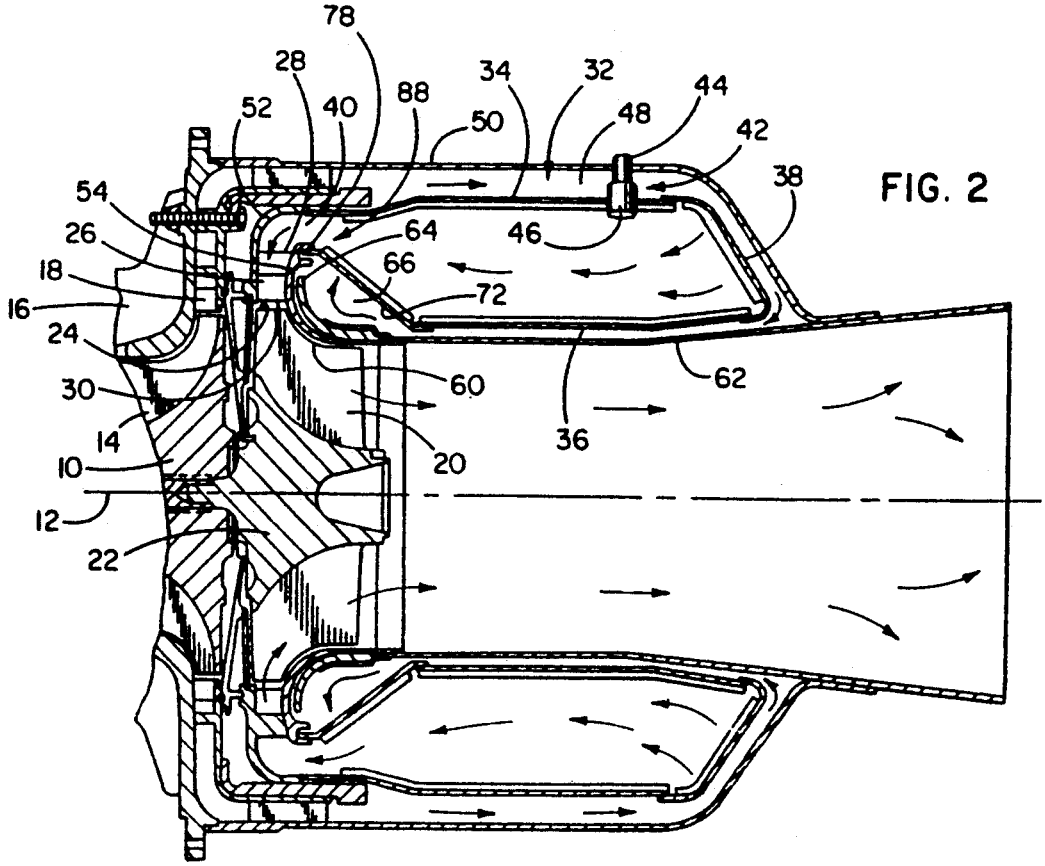
FIG. 2 is a cross-sectional view of a radial inflow gas turbine engine taken along line 2—2 in FIG. 1 showing the preferred embodiment of the invention.

Referring to FIGS. 1 and 2, the radial inflow turbine includes a rotor, generally designated 10, which is journaled by bearings (not shown) for rotation about an axis of rotation 12. On one side, the rotor 10 includes a series of compressor blades 14 which are operable to receive air from an inlet area 16 and compress the same and deliver the compressed air to a diffuser 18 of conventional construction. The compressor blades 14 define a radial outflow rotary compressor.

The opposite end of the rotor 10 is a turbine impeller section and includes a plurality of turbine blades 20. The turbine blades 20 define a radial inflow turbine impeller 22. Hot gases of combustion are directed against the radially outer edges 24 of the turbine blades 20 to drive the turbine impeller 22 and thus drive the rotor 10 about the axis of rotation 12.

Just radially outward of the edges 24 of the turbine blades 20 is an annular turbine nozzle assembly 88 made up of a plurality of nozzle blades or vanes 26. The nozzle vanes 26 have inlet or leading edges 28 as well as trailing edges 30.

The radial inflow turbine also includes a combustor, generally designated 32. The combustor 32 is an annular combustor and to that end includes a radially outer wall 34 which is concentric with the axis of rotation 12, a radially inner wall 36 which is also concentric with the axis of rotation 12, and a radially extending end wall 38. The end wall 38 interconnects the radially outer and inner walls 34 and 36. An outlet 40 of the combustor 32 opposite the end wall 38 serves as an outlet for hot gases resulting from combustion within the combustor 32.

A plurality of fuel injectors, each generally designated 42, are also provided. They are located at circumferentially spaced locations and are intended to direct fuel and primary combustion air in the annular combustor 32 in a generally tangential direction. To this end, a fuel tube 44 may be utilized for introducing fuel into the combustor 32 and a surrounding air tube 46 may be disposed about the fuel tube 44. The latter extends to a source of fuel under pressure while the surrounding air tube 46 extends just outside of the radially outer wall 34 to open into a compressed air plenum 48. The compressed air plenum 48 is defined by a plenum wall 50 in surrounding relation to the radially outer wall 34 and the radially extending end wall 38. The plenum wall 50 extends to the diffuser 18. Although the drawings illustrate a specific form of fuel injection, it is to be understood that the invention is applicable to other forms of fuel injection.

The turbine nozzle assembly 88 of the radial inflow turbine includes a front shroud 52 which separates the compressor and turbine sections of the rotor 10 and in addition, together with the plenum wall 50, serves as an inlet to the compressed air plenum 48. As can be readily appreciated, one function of the front shroud 52 is to turn axially flowing gases of combustion at the outlet 40 radially inward through the nozzle vanes 26.

Figure 3:
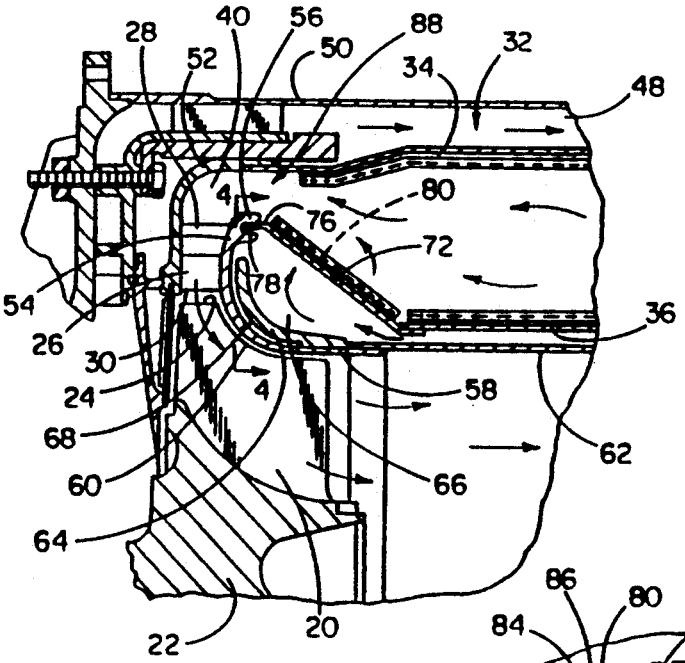
FIG. 3 is a fragmentary, sectional view of a combustor heat shield for a turbine containment ring illustrating the preferred embodiment of the invention.

The turbine nozzle assembly 88 of the radial inflow turbine also includes a rear turbine nozzle shroud 54. As can be seen in FIG. 3, the same is curved in section and has a generally radially directed, radially outer edge 56 which forms an annular lip 78. As one progresses radially inwardly, an increasing axial component is given to the shape so that at the radially inner edge 58, the rear turbine nozzle shroud 54 is generally axially extending. The rear turbine nozzle shroud 54 is in close adjacency to the peripheral edges 60 of the turbine blades 20 and serves to confine hot gases of combustion directed against the blades 20 by the nozzle vanes 26 in the space between the blades so that maximum energy can be derived therefrom.

In most instances, the construction will include a radially inner plenum wall 62 which extends from the radially inner edge 58 of the rear turbine nozzle shroud 54 to the radially innermost part of the plenum wall 50. The radially inner plenum wall 62 is located radially inward of the radially inner wall 36 so that compressed air may flow almost entirely about the combustor 32 for cooling the radially outer, inner and end walls 34, 36 and 38 thereof.

An annular containment ring 64 is disposed within a compressed air flow path 66 just upstream of the outlet 40 and the nozzle vanes 26. The containment ring 64 includes a first surface 68 in abutment with and in close radial proximity to the rear turbine nozzle shroud 54 which forms a portion of the turbine nozzle assembly 88 and may be mounted thereto by pins or fasteners.

Figure 4:
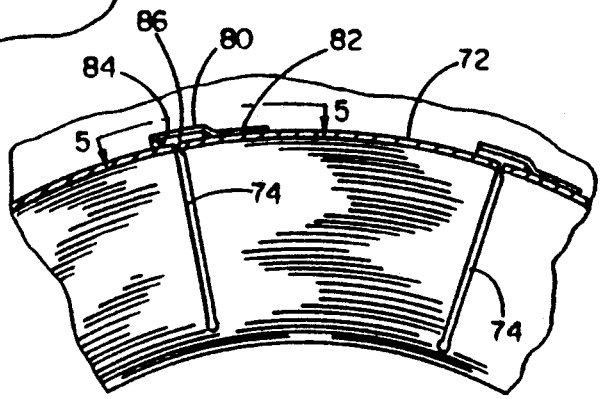
FIG. 4 is a fragmentary, sectional view of a combustor heat shield taken along line 4—4 in FIG. 3 showing the preferred embodiment of the invention.

In the illustrated embodiment of the invention, a heat shield 72 integrally forms a portion of the radially inner wall 36 of the combustor 32. As can be seen in FIG. 4, the heat shield 72 which integrally forms the portion of the radially inner wall 36 of the combustor 32 is provided with a plurality of slots 74 extending along the length of the heat shield 72. As shown in FIG. 3, at an end 76 of the radially inner wall 36 of the combustor 32, the slots 74 provided along the radially inner wall 36 abut the annular lip 78 of the radially outer edge 56 of the rear turbine nozzle shroud 54 which forms a portion of the turbine nozzle assembly 88. The slots 74 provided along the radially inner wall 36 of the combustor 32 allow for mechanical flexibility during construction of the turbine engine. In addition and more pertinent to the present invention, the slots 74 allow for thermal flexibility between the annular lip 78 of the rear turbine nozzle shroud 54 which forms a portion of the turbine nozzle assembly 88 and the heat shield 72 which integrally forms the portion of the radially inner wall 36 of the combustor 32. As high temperatures are generated from the hot gases in the combustor 32, the flexibility created by the slots 74 allows for a circumferentially uniform seal to form between the annular lip 78 of the rear turbine nozzle shroud 54 and the heat shield 72 during thermal transients. Such a circumferentially uniform seal accommodates differential growth between the rear turbine nozzle shroud 54 and the heat shield 72, and subsequent plastic deformation.

Figure 5:
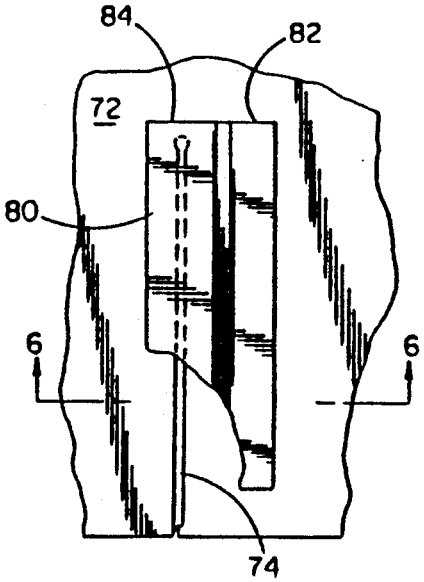
FIG. 5 is a fragmentary, sectional view of a combustor heat shield taken along line 5—5 in FIG. 4 showing the preferred embodiment of the invention.
Figure 6:
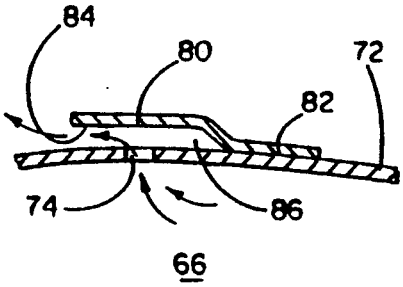
FIG. 6 is a fragmentary, sectional view of a combustor heat shield taken along line 6—6 in FIG. 5 showing the preferred embodiment of the invention.

As shown in FIGS. 4–6, the slots 74, which extend the length of the heat shield 72, are lined with lipped edges 80 which extend a substantial portion of the length of the slots 74. Each of the lipped edges 80 abuts the heat shield 72 at an abutting location 82 just tangentially outward of each of the slots 74. A shielding face 84 of each of the lipped edges 80 lies radially outward of each of the slots 74 to create a receiving space 86 for compressed air flowing through the compressed air path 66.

In the illustrated embodiment of the invention, as compressed air flows almost entirely about the combustor 32 for cooling the radially outer, inner and end walls 34, 36, and 38 thereof, the slots 74 which are provided along the radially inner wall 36 of the combustor 32 receive a portion of the compressed air flowing through the compressed air path 66. As the slots 74 receive the portion of compressed air, the same impinges upon the shielding face 84 of each of the lipped edges 80 which line the slots 74. Because of such impingement, the lipped edges 80 cause the compressed air to be directed along the heat shield 72 integrally forming the portion of the radially inner wall 36 of the combustor 32. As such, a film of cooling air is created along the heat shield 72 which is in close radial proximity to the second surface 70 of the containment ring 64. The film of cooling air created along the heat shield 72 allows the same to maintain acceptable operating temperatures. In such an embodiment, the heat shield 72, which integrally forms a portion of the radially inner wall 36 of the combustor 32, acts to separate the containment ring 64, which is in close radial proximity thereof, from the hot combustion gases within the combustor 32 via the film of cooling air, while simultaneously allowing for thermal flexibility between the annular lip 78 of the rear turbine nozzle shroud 54 and the heat shield 72. Thus, the containment ring 64 may be kept relatively cool to retain high performance material properties and containment capability in case of mechanical failure.

The lipped edges 80 of each of the slots 74 further direct the film of cooling air to the outlet 40 of the combustor 32 so that the compressed air combines with the hot combustion gases resulting from combustion within the combustor 32. This combination of compressed air with combustion by-products immediately preceding entry to the nozzle vanes 26 allows for extended life of the radially outer edges 24 of the turbine blades 20 which drive the turbine impeller 22 about the axis of rotation 12.

Although this invention has been illustrated and described in connection with the particular embodiments illustrated, it will be apparent to those skilled in the art that various changes may be made therein without departing from the spirit of the invention as set forth in the appended claims.

We claim:

1. A combustor heat shield assembly for a containment ring for use in a radial inflow turbine engine having a compressed air supply and a combustor, said combustor heat shield assembly comprising:

a turbine nozzle assembly means adapted for receiving a mixture of compressed air and combustion by-products delivered by said combustor to drive a turbine impeller of said radial inflow turbine engine about an axis of rotation, said turbine nozzle assembly means integrally connected with and in close radial proximity to said containment ring; and a heat shield means coupled to said turbine nozzle assembly means, said heat shield means thermally adapted for providing a circumferentially uniform seal between said turbine nozzle assembly means and said heat shield means during operation of said radial inflow turbine engine, said heat shield means in close radial proximity to said containment ring separating said containment ring from said mixture of compressed air and combustion by-products in said combustor, said heat shield means simultaneously adapted for receiving a portion of said compressed air supply and creating a film of cooling air along an inner surface of said heat shield means in close radial proximity to said containment ring, said film of cooling air along said inner surface of said heat shield means maintaining acceptable operating temperatures for said heat shield means separating said containment ring from said mixture of compressed air and combustion by-products in said combustor, said heat shield means further directing said film of cooling air to combine with said mixture of compressed air and combustion by-products in said combustor for delivery by said combustor to said turbine nozzle assembly means to drive said turbine impeller of said radial inflow turbine engine about said axis of rotation.

2. The combustor heat shield assembly of claim 1 wherein said heat shield means includes a heat shield integrally forming a portion of an inner wall of said combustor, said heat shield in close radial proximity to said containment ring separating said containment ring from said mixture of compressed air and combustion by-products in said combustor.

3. The combustor heat shield assembly of claim 2 wherein said heat shield includes slots, said slots provided along said inner surface of said heat shield integrally forming said portion of said inner wall of said combustor, said slots of said heat shield provided along said inner surface of said heat shield abutting an annular lip of said turbine nozzle assembly means in close radial proximity to said containment ring, said slots abutted to said annular lip of said turbine nozzle assembly means in close radial proximity to said containment ring allowing for thermal flexibility between said annular lip of said turbine nozzle assembly means and said inner surface of said heat shield integrally forming said portion of said inner wall of said combustor, said thermal flexibility providing a circumferentially uniform seal during operation of said radial inflow turbine engine.

4. The combustor heat shield assembly of claim 3 wherein said slots along said inner surface of said heat shield include lipped edges, said lipped edges lining said slots along said inner surface of said heat shield integrally forming said portion of said inner wall of said combustor, said slots lined with said lipped edges receiving said portion of said compressed air supply, said lipped edges of said slots directing said portion of said compressed air supply received by said slots along said inner surface of said heat shield integrally forming said portion of said inner wall of said combustor, said portion of said compressed air supply received by said slots and directed by said lipped edges creating said film of cooling air along said inner surface of said heat shield in close radial proximity to said containment ring, said film of cooling air along said heat shield maintaining acceptable operating temperatures for said heat shield separating said containment ring from said mixture of compressed air and combustion by-products, said lipped edges of said slots along said inner surface of said heat shield further directing said film of cooling air to combine with said mixture of compressed air and combustion by-products in said combustor for delivery by said combustor to said turbine nozzle assembly means to drive said turbine impeller of said radial inflow turbine engine about said axis of rotation.

5. The combustor heat shield assembly of claim 1 wherein said turbine nozzle assembly means is defined in part by a rear turbine nozzle shroud, said rear turbine nozzle shroud integrally connected with and in close radial proximity to said containment ring.

6. The combustor heat shield assembly of claim 5 wherein said heat shield means includes a heat shield integrally forming a portion of an inner wall of said combustor, said heat shield in close radial proximity to said containment ring separating said containment ring from said mixture of compressed air and combustion by-products in said combustor.

7. The combustor heat shield assembly of claim 6 wherein said heat shield includes slots, said slots provided along said inner surface of said heat shield integrally forming said portion of said inner wall of said combustor, said slots of said heat shield provided along said inner surface of said heat shield abutting an annular lip of said rear turbine nozzle shroud in close radial proximity to said containment ring, said slots abutted to said annular lip of said rear turbine nozzle shroud in close radial proximity to said containment ring allowing for thermal flexibility between said annular lip of said rear turbine nozzle shroud and said inner surface of said heat shield integrally forming said portion of said inner wall of said combustor, said thermal flexibility providing a circumferentially uniform seal during operation of said radial inflow turbine engine.

8. The combustor heat shield assembly of claim 7 wherein said slots along said inner surface of said heat shield include lipped edges, said lipped edges lining said slots along said inner surface of said heat shield integrally forming said portion of said inner wall of said combustor, said slots lined with said lipped edges receiving said portion of said compressed air supply, said lipped edges of said slots directing said portion of said compressed air supply received by said slots along said inner surface of said heat shield integrally forming said portion of said inner wall of said combustor, said portion of said compressed air supply received by said slots and directed by said lipped edges creating said film of cooling air along said inner surface of said heat shield in close radial proximity to said containment ring, said film of cooling air along said heat shield maintaining acceptable operating temperatures for said heat shield separating said containment ring from said mixture of compressed air and combustion by-products, said lipped edges of said slots along said inner surface of said heat shield further directing said film of cooling air to combine with said mixture of compressed air and combustion by-products in said combustor for delivery by said combustor to said turbine nozzle assembly means to drive said turbine impeller of said radial inflow turbine engine about said axis of rotation.

9. A combustor heat shield assembly for use in a radial inflow turbine engine having a compressed air supply and a combustor which delivers a mixture of compressed air and combustion by-products through a turbine nozzle assembly defined in part by a rear turbine nozzle shroud to drive a turbine impeller of said radial inflow turbine engine about an axis of rotation, said combustor heat shield assembly comprising:

a containment ring integrally connected with and in close radial proximity to said rear turbine nozzle shroud of said turbine nozzle assembly;

a heat shield integrally forming a portion of an inner wall of said combustor, said heat shield in close radial proximity to said containment ring separating said containment ring from said mixture of compressed air and combustion by-products in said combustor, said heat shield providing slots along an inner surface of said heat shield integrally forming said portion of said inner wall of said combustor, said slots of said heat shield provided along said inner surface of said heat shield abutting an annular lip of said rear turbine nozzle shroud in close radial proximity to said containment ring, said slots abutted to said annular lip of said rear turbine nozzle shroud in close radial proximity to said containment ring allowing for thermal flexibility between said annular lip of said rear turbine nozzle shroud and said inner surface of said heat shield integrally forming said portion of said inner wall of said combustor, said thermal flexibility providing a circumferentially uniform seal during operation of said radial inflow turbine engine; and said slots provided along said inner surface of said heat shield integrally forming said portion of said inner wall of said combustor lined with lipped edges, said slots lined with said lipped edges receiving a portion of said compressed air supply, said lipped edges of said slots directing said portion of said compressed air supply received by said slots along said inner surface of said heat shield integrally forming said portion of said inner wall of said combustor, said portion of said compressed air supply received by said slots and directed by said lipped edges creating a film of cooling air along said inner surface of said heat shield in close radial proximity to said containment ring, said film of cooling air along said heat shield maintaining acceptable operating temperatures for said heat shield separating said containment ring from said mixture of compressed air and combustion by-products in said combustor, said lipped edges of said slots along said inner surface of said heat shield further directing said film of cooling air to combine with said mixture of compressed air and combustion by-products in said combustor for delivery by said combustor to said turbine nozzle assembly to drive said turbine impeller of said radial inflow turbine engine about said axis of rotation.

* * * * *